US011203836B2

(12) United States Patent
Ceraudo

(10) Patent No.: US 11,203,836 B2
(45) Date of Patent: Dec. 21, 2021

(54) IRONING BOARD COVER WITH "PRESSING EFFECT"

(71) Applicant: Martijn Franciscus Maria Van Der Maas, Helmond (NL)

(72) Inventor: Rosario Ceraudo, Rumont (FR)

(73) Assignee: Martjin Franciscus Maria Van Der Maas, Helmond (NL)

( * ) Notice: Subject to any disclaimer, the term of this patent is extended or adjusted under 35 U.S.C. 154(b) by 172 days.

(21) Appl. No.: 16/548,890

(22) Filed: Aug. 23, 2019

(65) Prior Publication Data

US 2020/0071876 A1 Mar. 5, 2020

(30) Foreign Application Priority Data

Sep. 4, 2018 (FR) ..... 18 70989

(51) Int. Cl.
*D06F 83/00* (2006.01)
*D06F 81/14* (2006.01)

(52) U.S. Cl.
CPC ..... *D06F 83/00* (2013.01); *D06F 81/14* (2013.01)

(58) Field of Classification Search
CPC ..... D06F 83/00; D06F 81/00–14
See application file for complete search history.

(56) References Cited

U.S. PATENT DOCUMENTS 3,961,430 A * 6/1976 Mazzolla ..... D06C 15/04 38/66
4,360,984 A 11/1982 Ruttenberg ..... 38/140
4,903,421 A * 2/1990 Saito ..... D06F 81/00 223/57
5,274,846 A * 1/1994 Kolsky ..... A41D 13/0156 2/460
5,830,548 A * 11/1998 Andersen ..... B32B 27/20 428/36.4
5,849,394 A * 12/1998 Bussey, III ..... B32B 3/28 428/178
6,349,490 B1 * 2/2002 Gross ..... D06F 83/00 38/137

(Continued)

FOREIGN PATENT DOCUMENTS

BE 799 285 A 11/1973
CH 672 152 A5 10/1989 ..... D06F 83/00
DE 18 14 699 A1 6/1970

(Continued)

OTHER PUBLICATIONS

Search Report dated May 22, 2019 in related application No. FR 18 70989.

*Primary Examiner* — Ismael Izaguirre
(74) *Attorney, Agent, or Firm* — Renner, Kenner, Greive, Bobak, Taylor & Weber

(57) ABSTRACT

The invention concerns an ironing board cover (2) to cover the top surface of an ironing board and to form a support for the clothing during ironing, characterised in that it comprises an upper cover part (3) in the form of a cover, in particular of a material on which a pattern can be printed, for example cotton, and at least one part (5) defining a so-called active envelope containing air in an airtight manner to form at least one layer of air, the envelope being placed between the upper cover part and the side of the cover that comes into contact with the upper surface of the board.

15 Claims, 3 Drawing Sheets

(56) References Cited

U.S. PATENT DOCUMENTS

| | | | | |
|---|---|---|---|---|
| 7,131,223 | B2 * | 11/2006 | Krotts | D06F 83/00 38/140 |
| 2017/0021711 | A1 * | 1/2017 | Mansueto | B60J 11/08 |

FOREIGN PATENT DOCUMENTS

| | | | | |
|---|---|---|---|---|
| DE | 25 25 627 | A1 | 12/1976 | D06F 83/00 |
| EP | 3470572 | A1 * | 4/2017 | |

* cited by examiner

IRONING BOARD COVER WITH "PRESSING EFFECT"

TECHNICAL FIELD

The present invention relates to an item forming a cover for an ironing board intended to cover the top surface of an ironing board and to support the clothing during ironing. The present invention also refers to ironing boards fitted with a cover of this type.

BACKGROUND ART

Classically, a cover for an ironing board is made from cotton. It is also common to add additional sheets between the board and the cover. It is also common to form the cover in the form of a stack comprising from the top to the bottom, a covering part, a foam lining, a polyethylene film, an aluminised film and a thin layer of foam intended come into contact with the board. These classical covers, while improving the comfort of ironing, can be improved and the present invention proposes an ironing cover that is simpler to produce, and which in particular may comprise a smaller stack of parts while offering greater comfort for ironing, in particular by producing the effect known as "pressing".

SUMMARY OF THE INVENTION

According to the invention, an ironing cover intended to cover the surface of an ironing board and to form a support for the clothing to be ironed, is characterised in that it comprises an upper covering part in the form of a cover, in particular of a material on which a pattern can be printed, for example cotton, and at least one part defining a so-called active envelope which contains at least one airtight layer of air, the envelope being placed between the upper part of the cover and the side of the cover in contact with the upper surface of the board.

Preferably, a layer of aluminium is laid on at least one surface of the active envelope forming the layer of air, preferably on both the upper and lower surfaces.

Preferably, a lining, in particular of foam, is laid between the upper part of the cover and the active envelope, to protect the active envelope.

According to a preferred method of implementation of the invention, the active envelope is in the form of plastic packaging or wrapping material which contains encapsulated air cells such as BUBBLEWRAP®.

In particular, the plastic packaging or wrapping material which contains encapsulated air cells such as BUBBLEWRAP® consists of a basic film from one side of which project domes forming airtight bubbles containing air.

Preferably, the active envelope consists of plastic packaging or wrapping material which contains encapsulated air cells such as BUBBLEWRAP® comprising a basic film from one side of which project domes forming airtight bubbles containing air, the plastic packaging or wrapping material which contains encapsulated air cells such as BUBBLEWRAP® being folded back on itself so that the bubbles on one side come into contact with the bubbles on the other side.

In particular, the basic film is covered with a layer of aluminium on the side opposite to the bubbles.

A cover particularly effective for ironing is produced in this way, and in particular one which produces an effect known as "pressing", particularly suitable for ironing.

According to a preferred method of implementation of the invention, the bubbles are produced in the form of a network of bubbles, in particular hemispherical.

Preferably, each bubble has a diameter of between 5 and 15 mm, in particular 10 mm.

Preferably, there are between 10,000 and 25,000 bubbles per square meter, even more preferably between 15,000 and 20,000, in particular about 17,000.

Preferably, the bubbles are arranged in staggered rows, in particular of two layers.

The present invention also relates to an ironing board comprising a board with a cover according to the invention.

BRIEF DESCRIPTION OF THE DRAWINGS

For example, a preferred method of implementation of the invention is described with reference to drawings, in which.

DETAILED DESCRIPTION OF THE INVENTION

Figure 1:
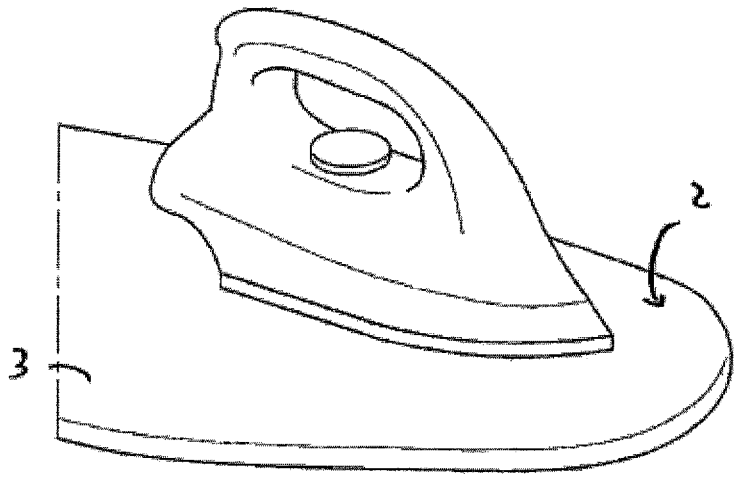
FIG. 1 shows a part of an ironing board with a cover according to the invention, the latter having been partly pulled back to enable the various constituent parts to be seen

FIG. 1 shows a part of an ironing board covered with a cover 2 according to one method of implementation of the invention.

The cover 2 has the classical shape of an ironing board cover which is turned back all round its edge so that it can, in an essentially flexible manner, be adapted to the edge of the board with the central part of the cover stretched over the upper surface of the board. For this reason, the surrounding edge of the cover has a lining 6 containing a flexible bead that stretches the cover over the table. Instead of the flexible bead, a tightening cord could be fitted to adjust the cover to the board or any other similar means to perform the same function.

Figure 2:
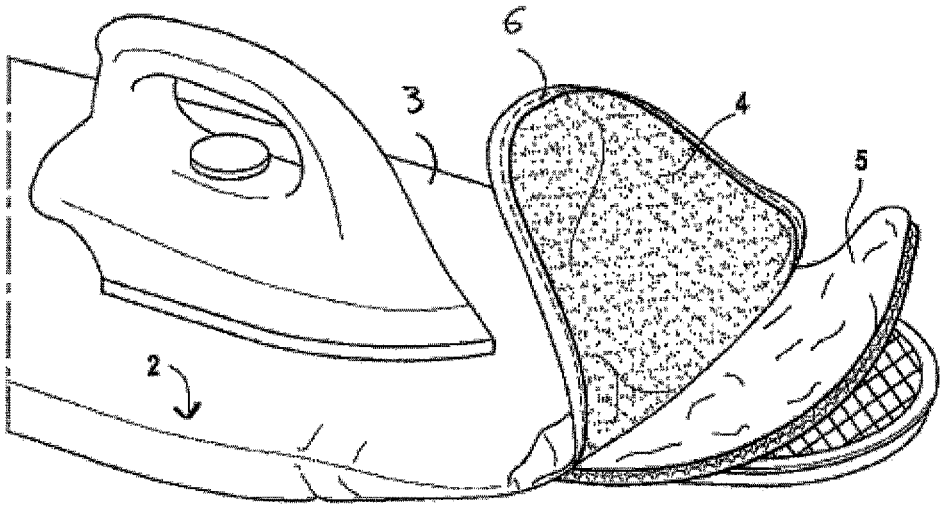
FIG. 2 shows part of an ironing board with a cover according to the invention.

FIG. 2 shows the first part of the cover, namely the upper part 3, the only part that can be seen when the cover is fitted over the board. This part is in general made from fabric, in particular cotton, and is preferably of a material that can be printed on to produce patterns.

The whole cover 2 consists of three superimposed parts that are held together over the surface of the table by the flexible bead fitted in the folded back part 6 of the first part 3 of the cover. Apart from part 3 of the cover, there is a sheet of foam 4 and a film 5 known as the "bubble film" whose upper and lower surfaces have been covered with a layer of aluminium. The two parts 4 and 5 have a shape that effectively matches the upper surface of the ironing board, while part 2 is larger, but is turned back around its edge to give an edge that is turned back around the two parts 4 and 5 to hold the parts together and against the board when in use.

According to another method of implementation, the cover can be made in a single part, the cover part 3, the foam sheet 4 and the bubble film 5 the latter being cut beforehand, preferably at the same time, to a size slightly larger than the ironing board, the three parts then being assembled by means of a stitched binding all round the cover forming a sheath in which a tightening cord (or a flexible bead or similar) slides freely for fitting the cover to the shape and size of the board.

The foam sheet 4 protects the aluminium layer of the bubble film. The plastic packaging or wrapping material which contains encapsulated air cells such as BUBBLEWRAP® 5 is a classical plastic packaging or wrapping material which contains encapsulated air cells such as BUBBLEWRAP® consisting of a certain number of domes 7 each defining a small bubble or airtight space in which air is trapped. The bubbles are arranged in rows and columns. Each bubble has a diameter of between 5 and 15 mm, and in particular 10 mm. The number of bubbles per square meter may, for example, be 17,200.

The material of the bubble film may in particular may be LDPE (low density Polyethylene), HDPE (high density Polyethylene), LLDPE (low linear density Polyethylene), Resy (recycled materials) or a mixture of these materials, in particular a LDPE 70%/HDPE 10%/LLPE 10%/Resy 10% mixture.

The thickness of the plastic packaging or wrapping material which contains encapsulated air cells such as BUBBLEWRAP® may be between 1 and 10 mm, in particular between 2 and 5 mm, for example 3.2 mm.

The bubbles are arranged in staggered rows, in particular of 2 layers with a pitch between 5 and 15 mm, in particular 10.5 mm.

The thickness of each layer constituting the film may be between 2 and 10 micrometers, in particular 5 micrometers.

The plastic packaging or wrapping material which contains encapsulated air cells such as BUBBLEWRAP® has been aluminised by the deposit of layers 9, 10 of aluminium on the upper and lower surfaces respectively of the bubble film.

Figure 3:
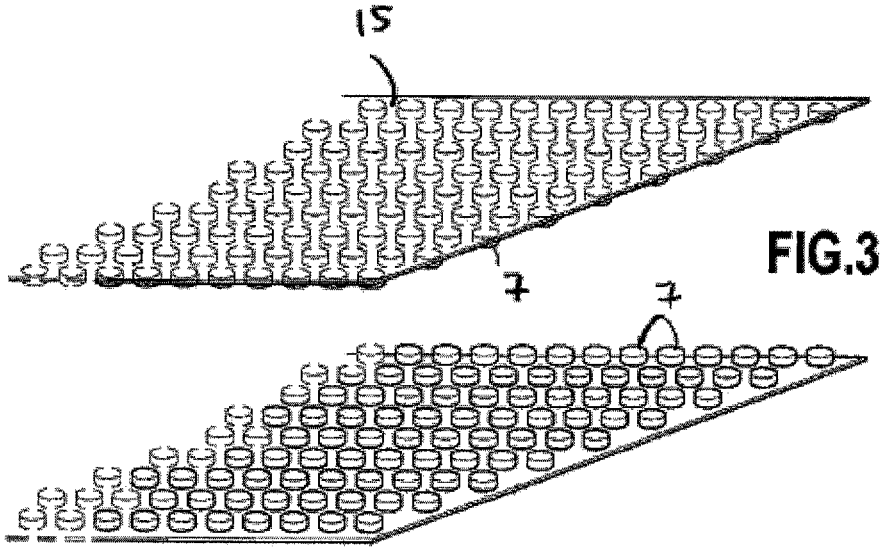
FIG. 3 is a perspective view of the active part of the cover in FIGS. 1 and 2, with both sides intended to be folded back at a distance from each other.
Figure 4:
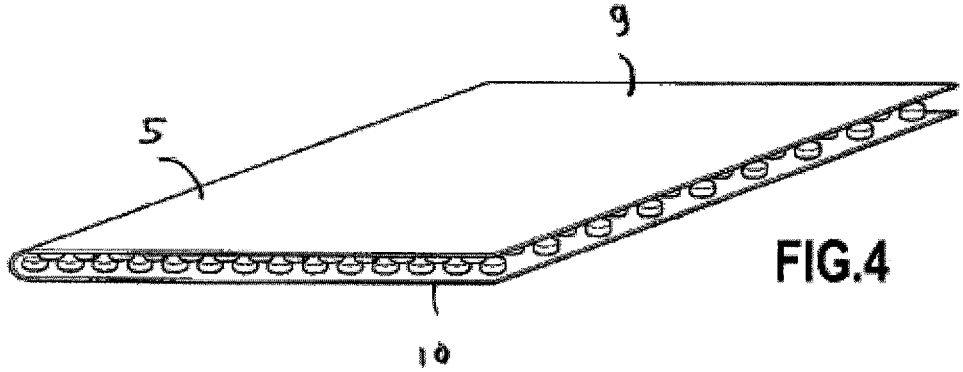
FIG. 4 is a perspective view of the active part in FIG. 3, in the position in which it is when used, namely with both sides folded back over each other.
Figure 5:
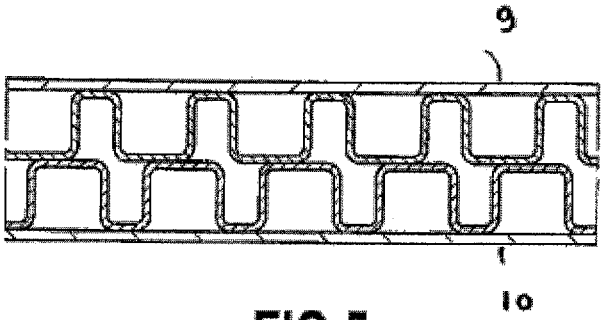
FIG. 5 is a cross-sectional view of the active part in FIG. 4.
Figure 6:
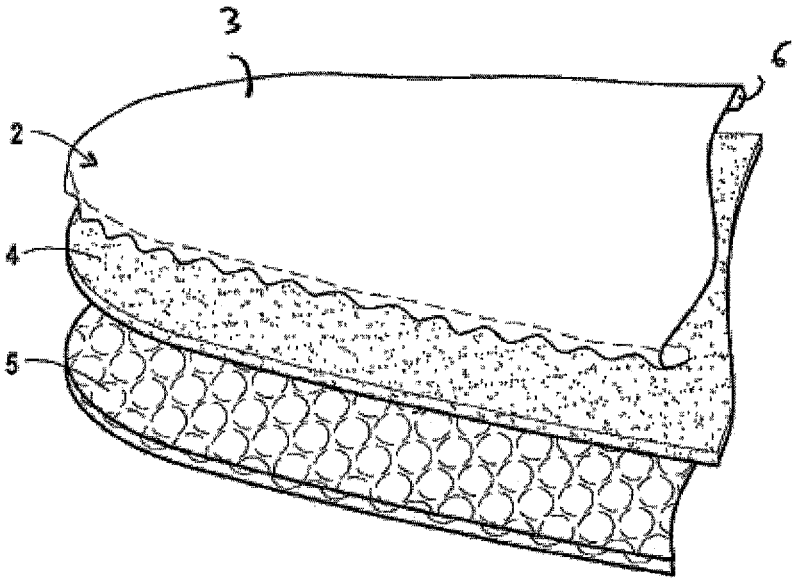
FIG. 6 shows the cover used in FIGS. 1 and 2, and in particular its constituent parts.

As seen in FIG. 3, the plastic packaging or wrapping material which contains encapsulated air cells such as BUBBLEWRAP® 5 consists of a basic film 15 from which project domes 7 forming the bubbles and the plastic packaging or wrapping material which contains encapsulated air cells such as BUBBLEWRAP® 5 has been folded back on itself so that the bubbles on one of the folded sheets come into contact with the bubbles on the other folded sheet, thereby producing the active envelope having two upper and lower surfaces respectively consisting of the two sheets of basic folded film and a layer of air formed by the two superimposed networks of bubbles. The surface of the basic film on the side opposite to the bubbles is covered with a layer of aluminium, so that the two upper and lower surfaces of the active envelope (each consisting of part of the basic folded film) are covered with a layer of aluminium.

The layer of aluminium may be a BOPP (bioriented Polypropylene) metallised, coextruded film, with a thickness of between 0.010 mm and 0.020 mm, in particular 0.015 mm and a surface density of between 100 and 120 gr/m$^2$, in particular 110.4 gr/m$^2$.

The BOPP film may consist of a layer of aluminium (vacuum deposited), a supporting metal receiving layer, a central OPP (oriented Polypropylene) layer and a heat-sealed layer.

This method of implementation by folding a plastic packaging or wrapping material which contains encapsulated air cells such as BUBBLEWRAP® is particularly simple, but, without exceeding the scope of the invention, a plastic packaging or wrapping material which contains encapsulated air cells such as BUBBLEWRAP® could be formed with two upper and lower films together defining one or more airtight spaces in which air is trapped.

The invention claimed is:

1. Ironing cover to cover the top surface of an ironing board and form a support for the clothing to be ironed during ironing, characterized in that it comprises an upper covering part and at least one part defining an active envelope in the form of a sheet of plastic packaging or wrapping material which contains encapsulated air cells which is placed between the upper covering part and the side of the ironing cover that comes into contact with the upper surface of the board.

2. The ironing cover according to claim 1, characterized in that a layer of aluminum is laid on at least one face of the active envelope.

3. The ironing cover according to claim 2, wherein both an upper and a lower surface of the active envelope contain an aluminum layer.

4. The ironing cover according to claim 1, characterized in that between the upper covering part of the cover and the active envelope, a lining is placed to protect the active envelope.

5. The ironing cover according to claim 4, wherein the lining is a foam lining.

6. The ironing cover according to claim 1, characterized in that the active envelope consists of a sheet of plastic packaging or wrapping material which contains encapsulated air cells comprising a film from one side of which project the encapsulated air cells, the plastic packaging or wrapping material which contains encapsulated air cells being folded back on itself so that the encapsulated air cells on one side come into contact with the encapsulated air cells on the other side.

7. The ironing cover according to claim 6, wherein the plastic packaging or wrapping material which contains encapsulated air cells is BUBBLEWRAP®.

8. The ironing cover according to claim 6, characterized in that the plastic packaging or wrapping material which contains encapsulated air cells is covered with a layer of aluminum on the side opposite to the encapsulated air cells.

9. The ironing cover according to claim 8, wherein the plastic packaging or wrapping material which contains encapsulated air cells is BUBBLEWRAP®.

10. The ironing cover according to claim 1, characterized in that each encapsulated air cell has a diameter of between 5 mm and 15 mm.

11. The ironing cover according to claim 1, characterized in that there are between 15,000 and 20,000 encapsulated air cells per square meter.

12. An ironing board comprising a top surface covered with a cover according to claim 1.

13. The ironing cover according to claim 1, wherein the upper covering part is made from a material permitting a pattern to be printed on it.

14. The ironing cover according to claim 13, wherein the material permitting a pattern to be printed on it is cotton.

15. The ironing cover according to claim 1, wherein the plastic packaging or wrapping material which contains encapsulated air cells is BUBBLEWRAP®.

* * * * *